US008033888B2

(12) United States Patent
Lorelli et al.

(10) Patent No.: US 8,033,888 B2
(45) Date of Patent: Oct. 11, 2011

(54) SIMULATED DEGRADATION FEATURES FOR REMOTELY CONTROLLED VEHICLES

(76) Inventors: Marc Lorelli, Northville, MI (US); Michael D. Turner, Plymouth, MI (US)

( * ) Notice: Subject to any disclaimer, the term of this patent is extended or adjusted under 35 U.S.C. 154(b) by 51 days.

(21) Appl. No.: 12/605,559

(22) Filed: Oct. 26, 2009

(65) Prior Publication Data

US 2010/0048096 A1 Feb. 25, 2010

Related U.S. Application Data

(62) Division of application No. 11/331,734, filed on Jan. 13, 2006, now Pat. No. 7,607,961.

(51) Int. Cl.
*A63H 17/02* (2006.01)
*A63H 33/00* (2006.01)

(52) U.S. Cl. ..... 446/6; 446/456

(58) Field of Classification Search ..... 446/4, 6, 446/454–456, 444, 470, 471, 484, 485
See application file for complete search history.

(56) References Cited

U.S. PATENT DOCUMENTS

| | | | | |
|---|---|---|---|---|
| 2,757,482 | A | 8/1956 | Brown et al. | |
| 2,803,920 | A | 8/1957 | Salosky | |
| 3,176,429 | A | 4/1965 | Brown et al. | |
| 4,571,197 | A | 2/1986 | Kulesza et al. | |
| 4,693,693 | A | 9/1987 | Kennedy et al. | |
| 5,380,231 | A | 1/1995 | Brovelli | |
| 5,713,783 | A | 2/1998 | Szoke et al. | |
| 6,033,285 | A * | 3/2000 | Fine et al. | 446/465 |
| 6,679,752 | B1 | 1/2004 | Reed, Sr. | |
| 6,732,602 | B2 | 5/2004 | Lu | |
| 6,840,839 | B2 | 1/2005 | Rehkemper et al. | |
| 7,029,363 | B2 | 4/2006 | Ogihara | |
| 2002/0142701 | A1 | 10/2002 | Rosenberg | |
| 2003/0148703 | A1 | 8/2003 | Scott et al. | |
| 2004/0082268 | A1 | 4/2004 | Choi | |
| 2005/0145313 | A1 | 7/2005 | Yokobori | |
| 2005/0156399 | A1 | 7/2005 | Chu | |

* cited by examiner

*Primary Examiner* — Kien Nguyen

(74) *Attorney, Agent, or Firm* — Brooks Kushman P.C.

(57) ABSTRACT

Various degradation features are disclosed for a remotely controlled vehicle. Translatable body components are disclosed for simulating damage to a vehicle. Impact sensors may be provided for detecting an impact to the vehicle and modifying operation of the vehicle in response to an impact. A timer may be provided for hampering operations of the vehicle as a function of time for simulating real life conditions. Controls, and methods associated with these features are disclosed as well as games for utilizing the degradation features.

20 Claims, 10 Drawing Sheets

SIMULATED DEGRADATION FEATURES FOR REMOTELY CONTROLLED VEHICLES

CROSS-REFERENCE TO RELATED APPLICATIONS

This application is a division of U.S. application Ser. No. 11/331,734 filed Jan. 13, 2006, now U.S. Pat. No. 7,607,961, the disclosure of which is incorporated by reference herein.

BACKGROUND OF THE INVENTION

1. Field of the Invention

The invention relates to remotely controlled vehicles.

2. Background Art

Remotely controlled vehicles are often utilized by enthusiasts and children for play and entertainment. Remotely controlled vehicles simulate the control of real life vehicles, such as automobiles, aircrafts, water crafts, or the like.

SUMMARY OF THE INVENTION

An embodiment of the present invention provides a remotely controlled vehicle with a housing and a propulsion device on the housing for translating the vehicle. A receiver is provided on the housing in communication with the propulsion device for receiving signals from a remote control and for controlling the propulsion device. A body is provided having at least one translatable body component adapted for translation from a first position to a second position upon impact of the vehicle for simulating an appearance of a damaged vehicle.

Another embodiment of the present invention is to provide a remotely controlled vehicle having a housing, with a propulsion device on the housing for translating the vehicle, and a receiver provided on the housing for receiving signals from a remote control. A controller is in communication with one of the receiver and the propulsion device for controlling the propulsion device. The controller alters control of the propulsion device to simulate operation of a vehicle requiring maintenance.

Yet another embodiment of the present invention is to provide a computer-readable medium having computer-executable instructions for performing a method comprising a step of receiving a signal associated with manually input controls for driving a remotely controlled vehicle. A signal is transmitted to a propulsion device of the vehicle corresponding to the manually input controls. A modified signal is transmitted to the propulsion device associated with the manually input controls to simulate a vehicle requiring maintenance.

The above embodiments, and other embodiment, aspects, objects, features, and advantages of the present invention are readily apparent from the following detailed description of embodiments of the invention when taken in connection with the accompanying drawings.

DETAILED DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as representative basis for teaching one skilled in the art to variously employ the present invention.

Figure 1:
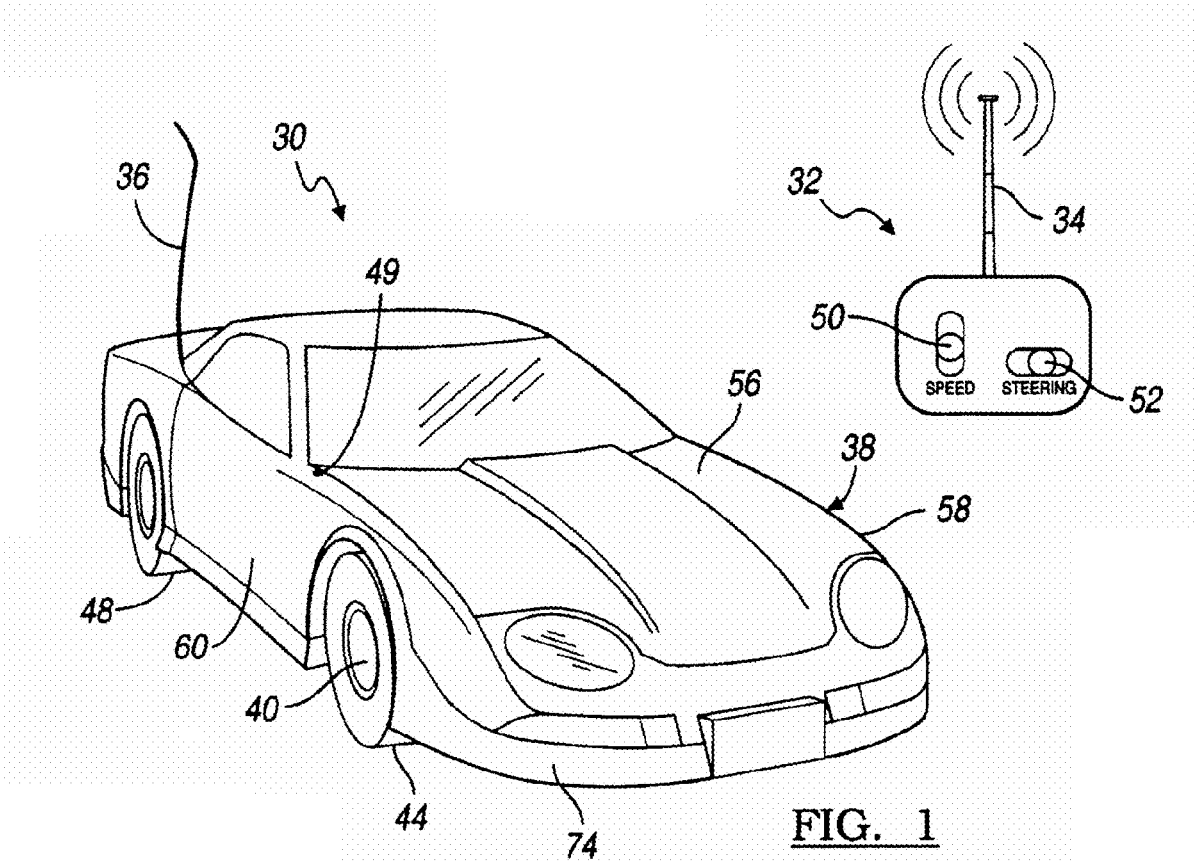
FIG. 1 is a perspective view of a remotely controlled vehicle in accordance with the present invention.

With reference now to FIG. 1, a remotely controlled vehicle embodiment is illustrated in accordance with the present invention and is referenced generally by numeral 30. The vehicle 30 is illustrated as an automobile, however the invention contemplates that any vehicle may be utilized in accordance with the present invention, including aircrafts, watercrafts, figurines, animals, or the like.

The vehicle 30 is remotely controlled from a remote control 32, which is in communication with the vehicle 30 for controlling operations of the vehicle 30. Although the remote control 32 is illustrated with an antenna 34 and the vehicle is illustrated with an antenna 36, the invention contemplates that the remote control 32 may communicate with the vehicle 30 by other forms of communication, including hard wiring, or the like.

The remotely controlled vehicle depicted in FIG. 1 represents a race car such as a stock car. Of course, any vehicle is contemplated in accordance with the present invention. For example, a vehicle modeled after a demolition derby car would be well-suited for the benefits and advantages of the present invention. The vehicle 30 has a vehicle body 38 that provides the vehicle 30 with its aesthetic appearance. Accordingly, various vehicle bodies may be provided for utilization with the remotely controlled vehicle 30, such as various automobiles, race cars, futuristic vehicles or the like. The vehicle body 38 is mounted to a vehicle chassis 40 that may include, for example, four wheels 42, 44, 46, 48. The vehicle body 38 potentially includes a mounting hole pattern 49 and the chassis 40 has a corresponding mounting hole pattern for interchanging various vehicle bodies 38 to the chassis 40.

The vehicle 30 includes a receiver, which receives signals from the remote control 32 for directing the vehicle. Although various vehicle operating conditions are contemplated by the present invention, various features of the present invention are set forth below with reference to a remote control, such as the remote control 32 that is depicted with a speed control lever 50 and a steering control lever 52 for manually controlling speed and steering of the vehicle 30.

Figure 2:
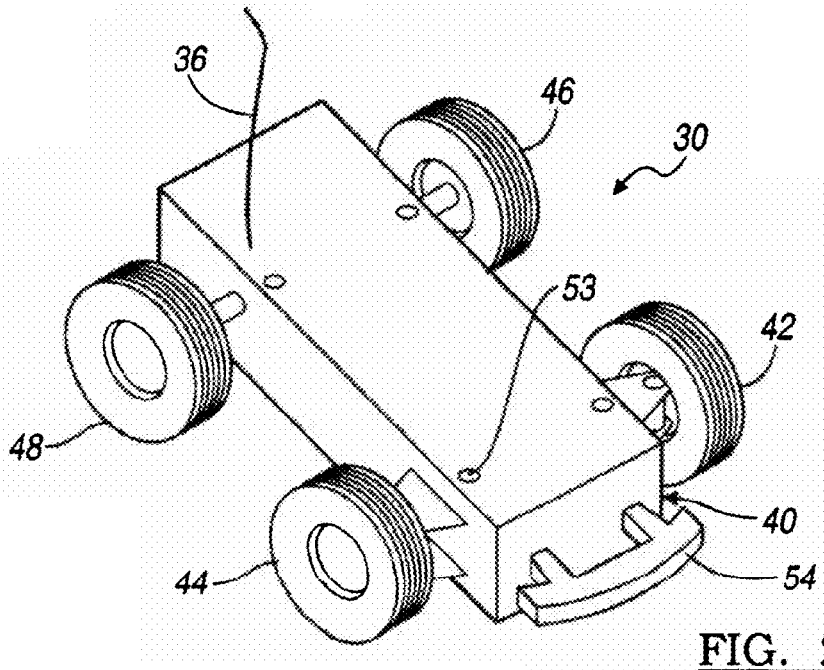
FIG. 2 is a perspective view of the remotely controlled vehicle of FIG. 1, illustrated with a body removed therefrom.

With reference to FIG. 2, the vehicle 30 is illustrated with the vehicle body 38 removed thereby exposing the vehicle chassis 40. As discussed above, the chassis 40 may include a hole mounting pattern 53 for receiving the vehicle body 38 or other various vehicle bodies. The chassis 40 includes a housing which may contain the receiver for receiving the signals from the remote control 32. Further, the chassis 40 houses a propulsion device for translating the vehicle 30. For the particular embodiment, the propulsion device drives the rear wheels 46, 48 and steers the front wheels 42, 44 in any suitable manner.

For example, the propulsion device may include a power source such as a direct current (DC) battery pack for powering a motor, which drives the rear wheels 46, 48 through a gearbox for reducing the speed from the motor and increasing the torque from the motor. A second motor may be provided for controlling the steering of the front wheels 42, 44. Thus, the user may remotely control the vehicle 30 by operating the speed control lever 50 for driving the rear wheels 46, 48, while concomitantly steering the vehicle 30 by actuating the steering control lever 52 such that the steering motor causes the front wheels 42, 44 to each pivot relative to the chassis 40.

Similar to prior art remotely controlled vehicles, the remote controlled vehicle 30 may include a suspension system for suspending the chassis 40 and vehicle body 38 relative to the wheels 42, 44, 46, 48 for dampening vibrations imparted thereto. Additionally, a bumper frame may be provided on the front and/or rear of the chassis 40 as depicted by the front end bumper frame 54 for absorbing front end or rear end impacts, which are associated with remotely controlled vehicles.

Since remotely controlled vehicles are often utilized for competition, such as races, demolition derbies or the like, the remote controlled vehicle 30 is provided with simulated degradation features characteristic of a damaged vehicle or vehicle requiring maintenance to thereby add additional factors to the competition, which are typically associated with real life competitions. Accordingly, the vehicle body 38 of the vehicle 30 is provided with a series of translatable body components, which are affixed to the body 38 under normal condition, but are translated to a second position, which may include a removed position, relative to the vehicle body 38 upon impact.

More specifically, the vehicle body 38 may include a series of body components that are deployable from the vehicle body 38 upon impact. Therefore, impacts to the vehicle 30 cause the vehicle 30 to lose a body component thereby providing an appearance of a damaged vehicle. Further, loss of body components may hamper the aerodynamics of the vehicle 30 thereby adding difficulty to the competition. Further, loss of vehicle body components upon a field of competition, such as a track, may provide new obstacles for competitors.

Additionally, various games may be incorporated into a competition. For example, a pair of vehicles 30 may be utilized for a demolition derby whereby the first competitor to lose all deployable components of the associated vehicle body 38, may result in a programmed shutdown, and therefore, that competitor loses the competition. Alternatively, the users may race the vehicles 30, however, if a vehicle loses a predefined number of deployable body components during a race, then that user must forfeit the race. Of course, various other games may be contemplated within the spirit and scope of the present invention.

Various deployable vehicle body components are contemplated in accordance with the present invention. For the stock car embodiment illustrated in FIGS. 1 and 2, the vehicle 30 may have deployable components that typically undergo damage or are subjected to removal during conventional stock car racing. For example, the remotely controlled vehicle 30 may be provided with a deployable hood 56, side panels 58, 60 and a rear panel 62, which may include a rear bumper, decklid and/or spoiler.

Figure 3:
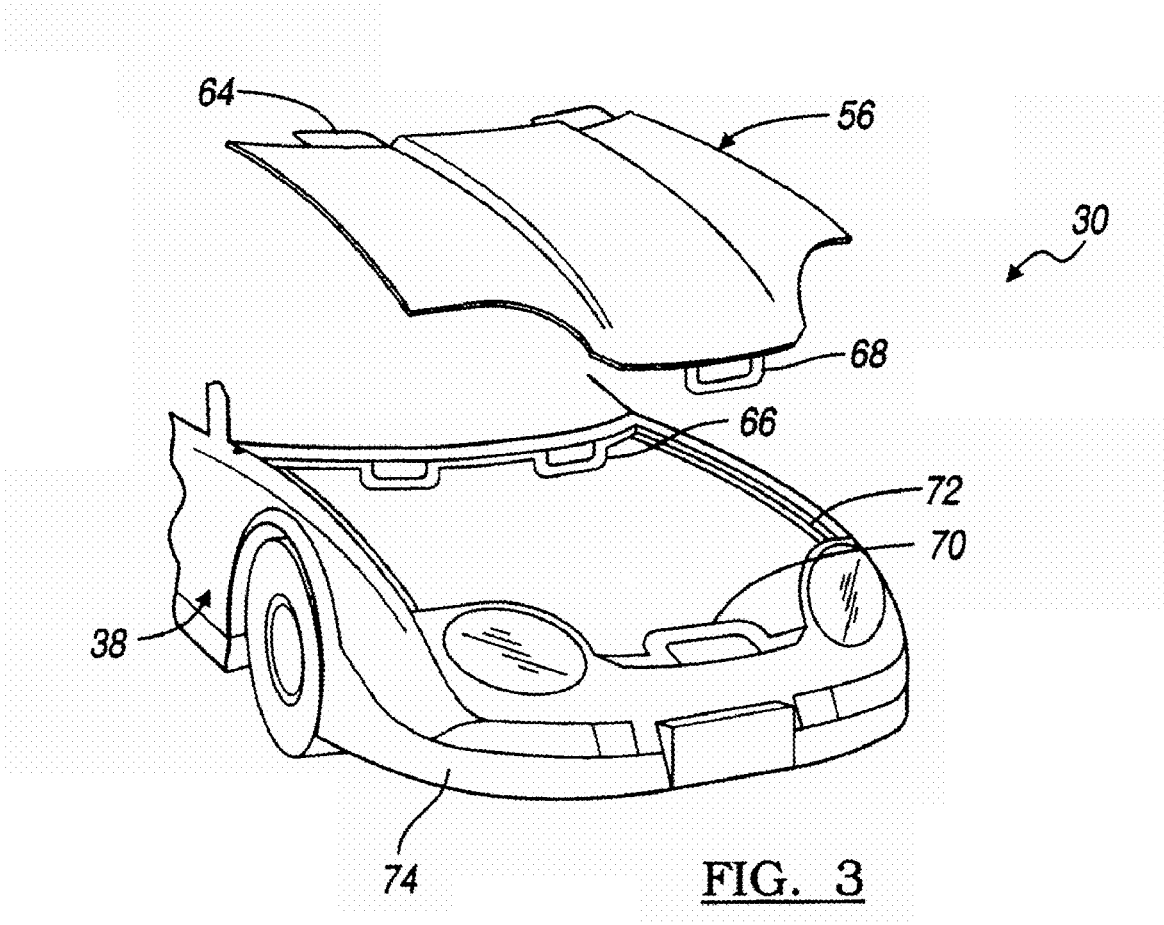
FIG. 3 is a partially exploded perspective view of the remotely controlled vehicle of FIG. 1.

Referring now to FIG. 3, an exemplary vehicle body 38 is illustrated partially exploded with the deployable hood 56 removed therefrom. Vehicle hoods often undergo damage associated with a front end impact, wherein a front bumper or bumper frame of the vehicle is deformed thereby weakening or breaking a connection of the hood to the vehicle whereby air collects under the hood and removes the hood from the vehicle. A similar condition is simulated by the vehicle body 38.

The hood 56 includes a pair of tabs 64 which are received in corresponding slots 66 within the vehicle body 38 beneath a hood opening. The hood 56 is also provided with a striker 68 for engaging a latch mechanism 70 of the vehicle body. A pair of leaf springs 72 may be provided beneath the hood 56 on the vehicle body 38 for biasing the hood 56 to a deployed orientation. Thus, upon disengagement of the latch mechanism 70, the leaf springs 72 will assist ejection of the hood 56 from the vehicle body 38. Although leaf springs 72 are illustrated and described, the invention contemplates any biasing member within the spirit and scope of the present invention. Leaf springs 72 are utilized for providing a streamlined appearance with the hood opening of the vehicle body 38, which may be less noticeable then other springs such as coil springs when the hood 56 becomes disassociated.

The latch mechanism 70 is configured to release the striker 68 of the hood 56 upon a front end impact. Accordingly, a front bumper fascia 74 of the vehicle body 38 is translatable relative to the vehicle body 38 for actuating the latch mechanism 70 upon impact.

Figure 4:
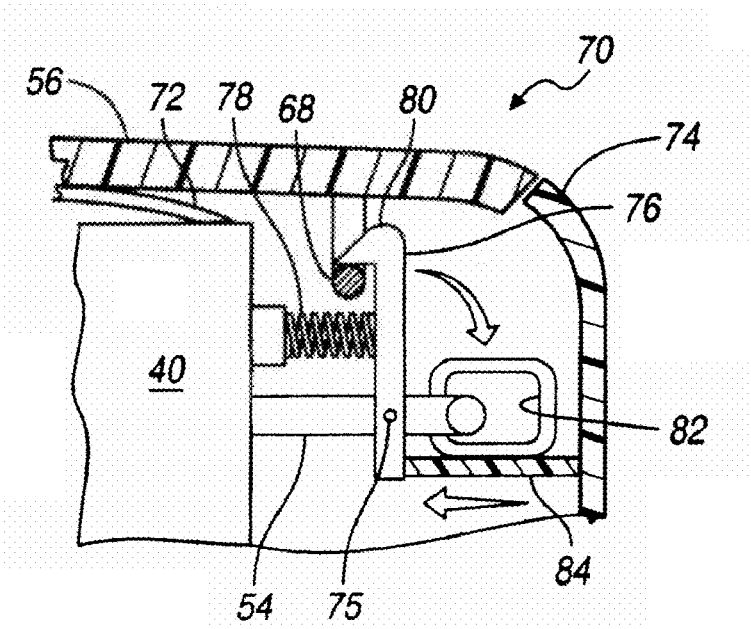
FIG. 4 is an enlarged, partial section view of the remotely controlled vehicle of FIG. 1, taken along a connection of a body component to the body of the vehicle.

Referring now to FIG. 4, the latch mechanism 70 is illustrated in partial section for depicting the cooperation of the hood 56, latch mechanism 70 and the vehicle body 38. The latch mechanism 70 includes a hook member 76 pivotally connected to the bumper frame 54. An extension coil spring 78 is connected to the hook member 76 and the chassis 40 for urging the hook member 76 to a latched position by pulling the hook member 76 rearward relative to the vehicle 30. The hook member 76 includes an inclined leading edge 80 so that as the hood 56 is being assembled to the vehicle body 38, the striker 68 engages the leading edge 80 and urges the hook member 76 to an unlatched position. Once the striker 68 is translated past the leading edge 80, the extension coil spring 78 urges the hook member 76 to the latched position thereby retaining the hood 56 upon the vehicle body 38.

The front bumper fascia 74 includes a pair of slots 82 on lateral sides of the bumper fascia for engaging lateral distal ends of the bumper frame 54 for retaining the bumper fascia 74 to the bumper frame 54. An actuator tab 84 is provided within the bumper fascia 74 extending inward for engaging an opposed distal end of the hook member 76. The extension coil spring 78 urges the lower distal end of the hook member 76 into engagement with the actuator tab 84 such that the bumper fascia 74 is at a forward most orientation relative to the bumper frame 54. Upon impact, the front bumper fascia 74 is actuated rearward as indicated by the linear arrow in FIG. 4, thereby causing the hook member 76 to rotate clockwise as illustrated by the arcuate arrow in FIG. 4 about pivot pin 75 to an unlatched position whereby the hood 56 is ejected from the vehicle body 38. The extension coil spring 78 may be sized to require an impact of a predefined momentum such that incidental contact of the bumper fascia 74 does not deploy the hood 56.

Figure 5:
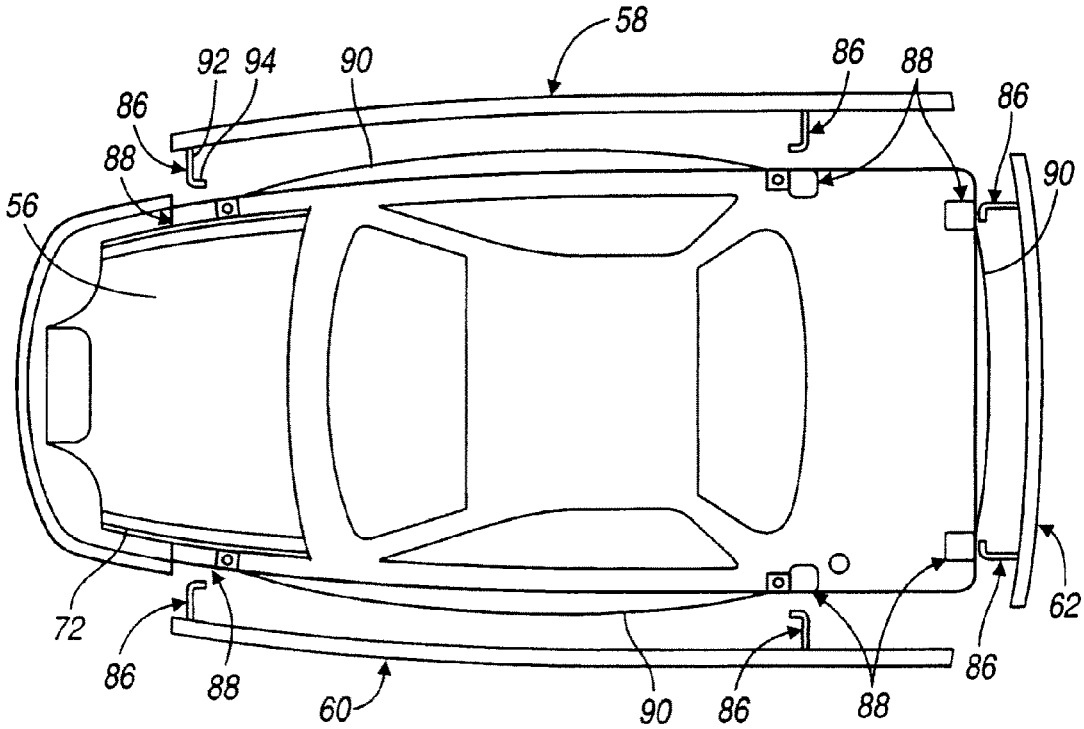
FIG. 5 is a bottom plan view of the body of the remotely controlled automotive vehicle of FIG. 1.

With reference now to FIG. 5, the vehicle body 38 is illustrated from its underside with the side panels 58, 60 and the rear panel 62 disassembled from the vehicle body 38. Unlike the hood 56, the side panels 58, 60 and the rear panel 62 are deployable upon direct impact to these components 58, 60, 62. Each of the deployable panels 58, 60, 62 includes a pair of strikers 86 for receipt with a corresponding latch socket 88 provided on the vehicle body 38. Additionally, a series of leaf springs 90 are provided on the vehicle body 38 for biasing the body panels 58, 60, 62 respectively away from the vehicle body 38 so that upon disengagement of the strikers 86 from the latch sockets 88, the leaf springs 90 assist in ejection of the associated body panel 58, 60, 62.

The invention contemplates various deployable body components for various remotely controlled vehicles within the spirit and scope of the invention; and one having ordinary skill in the art of the present invention may employ the teachings of the present invention in various embodiments of the invention not specifically illustrated or described herein.

Figure 6:
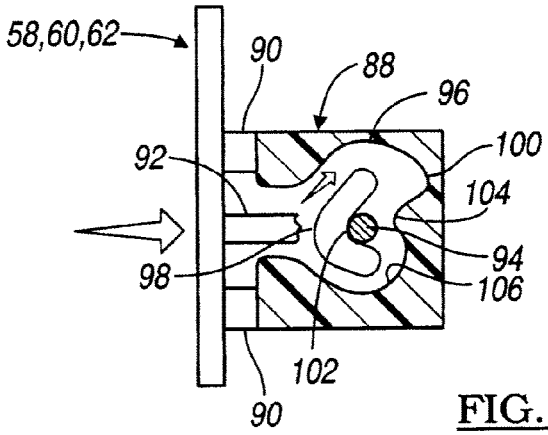
FIG. 6 is another enlarged section view of the automotive vehicle of FIG. 1, illustrating another connection of a body component to the body of the vehicle.

Referring now to FIG. 6, one of the latch sockets 88 is illustrated in cross section. Each striker 86 includes a bracket 92 extending from the corresponding panel 58, 60, 62. A pin 94 extends transversely from the bracket 92 for receipt within a path 96 formed within each latch socket 88.

The path 96 is a similar to a toggle button path, which is conventionally utilized in toggle buttons with a closed path for repeat actuations. As the pin 94 is inserted within the path 96 it engages a fork 98 in the path which causes the pin 94 to follow one of two divergent paths, as indicated by the arrow in FIG. 6. The leading edge on the fork 98 causes the pin 94 to follow the uppermost of the divergent paths. Upon reaching a first forward peak 100 in the path 96, the translation of the pin 94 into the socket 88 reaches a limit of travel. Upon release of a force to the panel 58, 60, 62 during assembly, the leaf springs 90 urge the panel 58, 60, 62 away from the socket 88 such that the pin 94 is received within a concave recess 102 within the path 96. Thus, the body panel 58, 60, 62 is oriented in an assembled orientation of the vehicle body 38.

Upon receiving an impact as indicated by the linear arrow in FIG. 6, the pin 94 engages an inclined surface of a fork 104 within the path 96 thereby urging the pin 94 to a second forward peak 106 within the path 96. Upon release of the impact, the leaf springs 90 urge the body panel 58, 60, 62 away from the latch socket 88 such that the pin 94 follows the path 96 past the fork 98 and out of the socket 88 for disconnecting or unlatching the striker 86 from the latch socket 88. Accordingly, the associated body panel 58, 60, 62 is deployed from the vehicle body 38.

Figure 7:
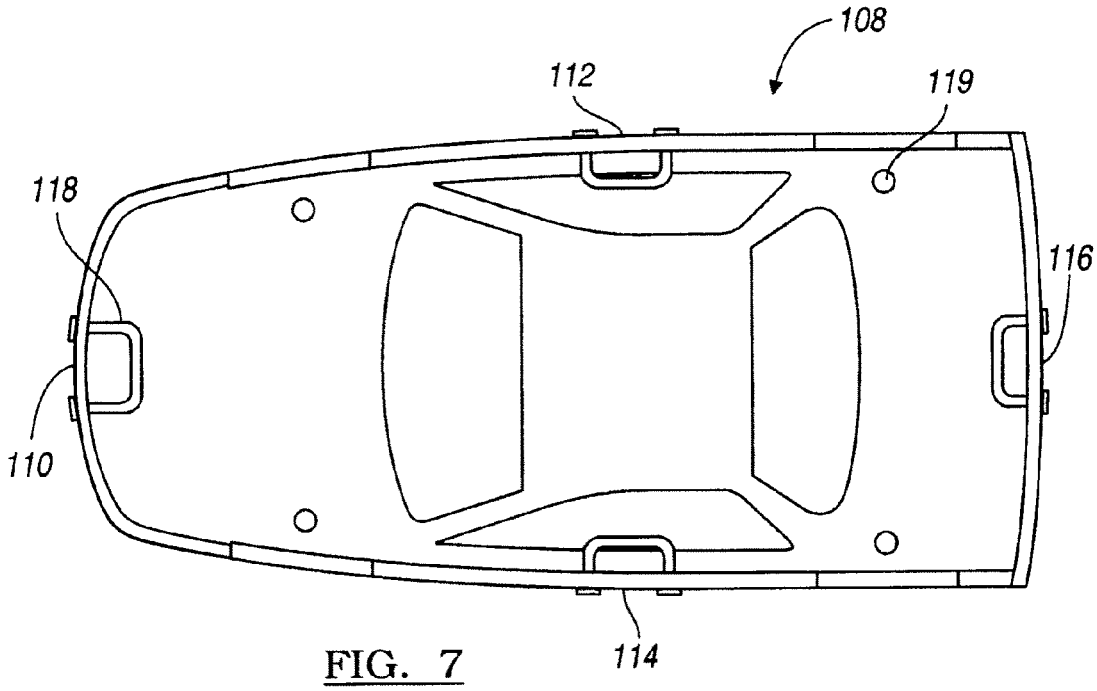
FIG. 7 is a bottom plan view of another body of a remotely controlled vehicle in accordance with the present invention.

The invention contemplates employing translatable body components that may be retracted relative to the vehicle body for depicting a damaged or dented vehicle, without deploying body components from the vehicle body. With reference now to FIG. 7, an elastomeric unitary vehicle body 108 is illustrated in accordance with the present invention. The vehicle body 108 is illustrated from the underside for revealing components therein. The vehicle body 108 provides a unitary vehicle body appearance when viewed externally from the associated remotely controlled vehicle. The vehicle body 108 includes a series of body panels that are deformable relative to the vehicle body, such as a bumper 110, side panels 112, 114 and a rear bumper 116. Each of these body panels 110, 112, 114, 116 are provided with a striker 118 within the vehicle body 108.

Figure 8:
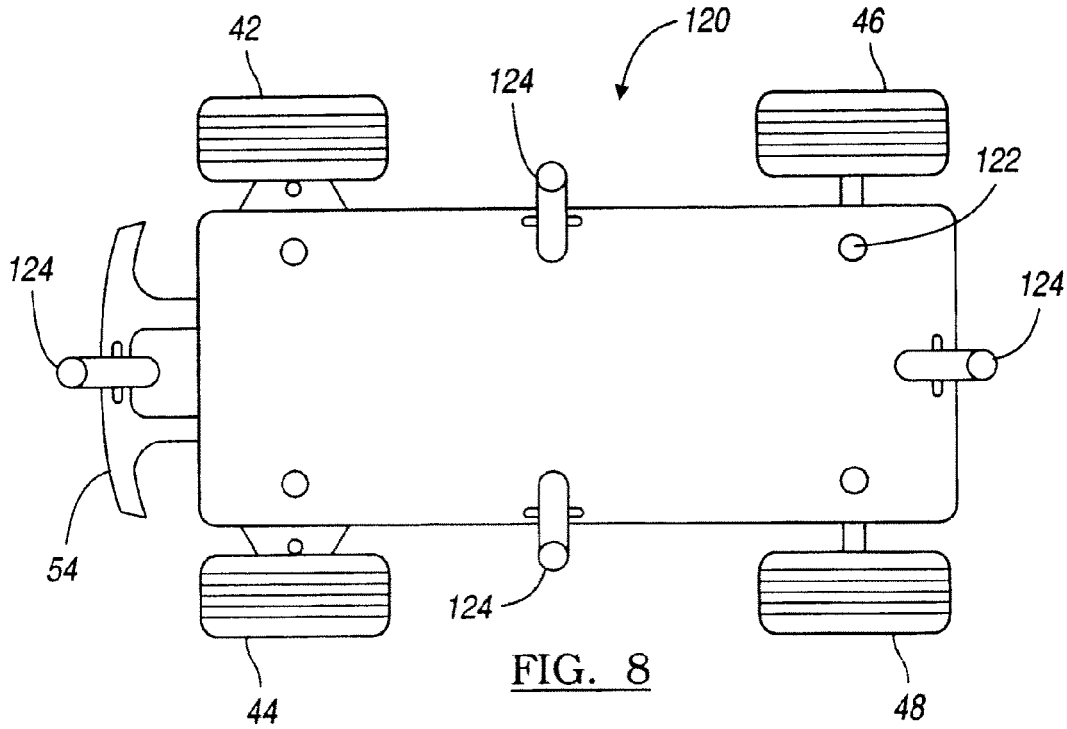
FIG. 8 is a bottom plan view of a chassis of a remotely controlled vehicle for utilization with the body of FIG. 7.

The vehicle body 108 may include a mounting pattern 119 for fastening the vehicle body 108 to an associated chassis, such as chassis 120 illustrated in FIG. 8 with corresponding mounting pattern 122. The vehicle body 108 is fixed relative to the chassis 120, such that impacts to the panels 110, 112, 114, 116 cause the strikers 118 to translate relative to the vehicle body 108. Accordingly, a series of latch mechanisms 124 are provided on the chassis 120.

Figure 9:
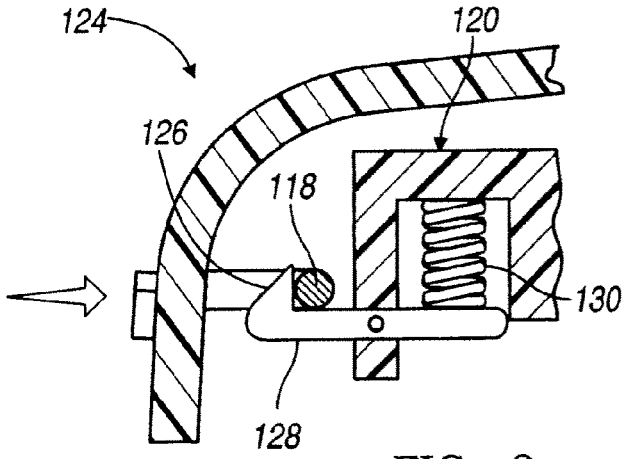
FIG. 9 is an enlarged partial section view of a latch mechanism of the remotely controlled vehicle of FIGS. 7 and 8.

With reference to FIG. 9, after the associated body panel has received an impact in a direction of the linear arrow, the striker 118 engages a leading edge 126 of a hook member 128 of the latch mechanism 124. The hook member 128 is pivotally connected to the chassis 120 and is biased to the latched position by a compression coil spring 130 provided between a distal end of the hook member 128 and the chassis 120. Thus, after impact to the associated panel 110, 112, 114, 116, the panel is maintained in the deformed position due to the striker engagement with the latch mechanism. The striker 118 may be disengaged from the latch mechanism 124 by pressing the distal end of the hook member 128, which is readily accessible from the underside of the chassis 120.

Figure 10:
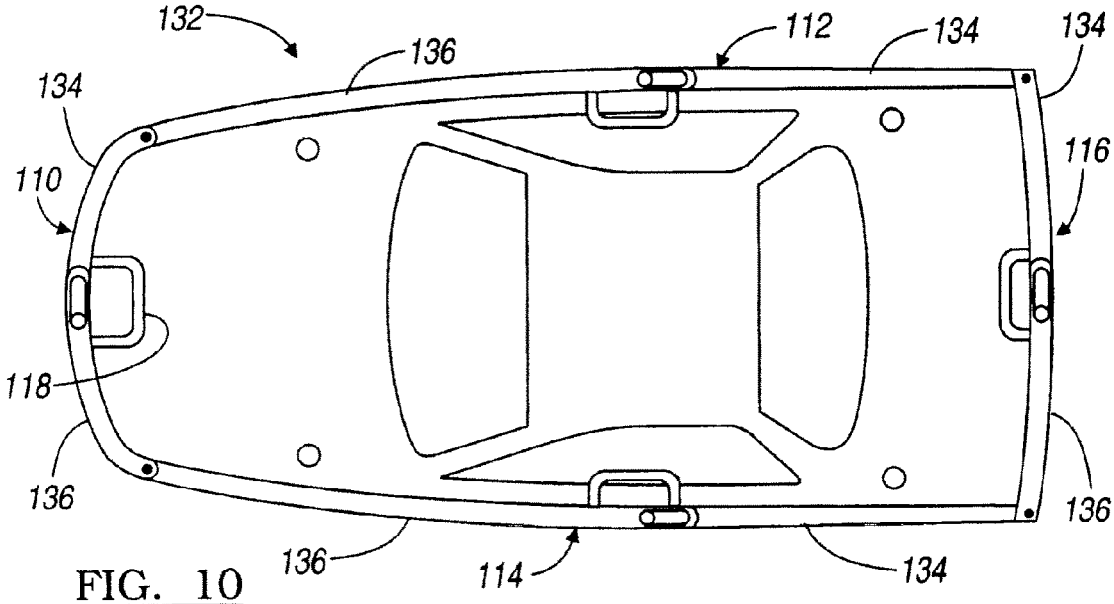
FIG. 10 is a bottom plan view of another body for a remotely controlled vehicle in accordance with the present invention, the body may be utilized with the chassis of FIG. 8.

In FIG. 10, an alternative vehicle body 132 is illustrated in accordance with the present invention. The vehicle body 132 is deformable similar to the vehicle body 108 at FIG. 7. However, each panel 110, 112, 114, 116 of the vehicle body 132 is provided as a linkage with a pair of links 134, 136 pivotally connected to the vehicle body 132 and pivotally interconnected to each other. A pivotal connection is provided on the link 134 and a slot is formed in the link 136 so that the links 134, 136 can be pivoted inward relative to the vehicle body 132 until the striker 118 engages a corresponding ledge mechanism 124.

Figure 11:
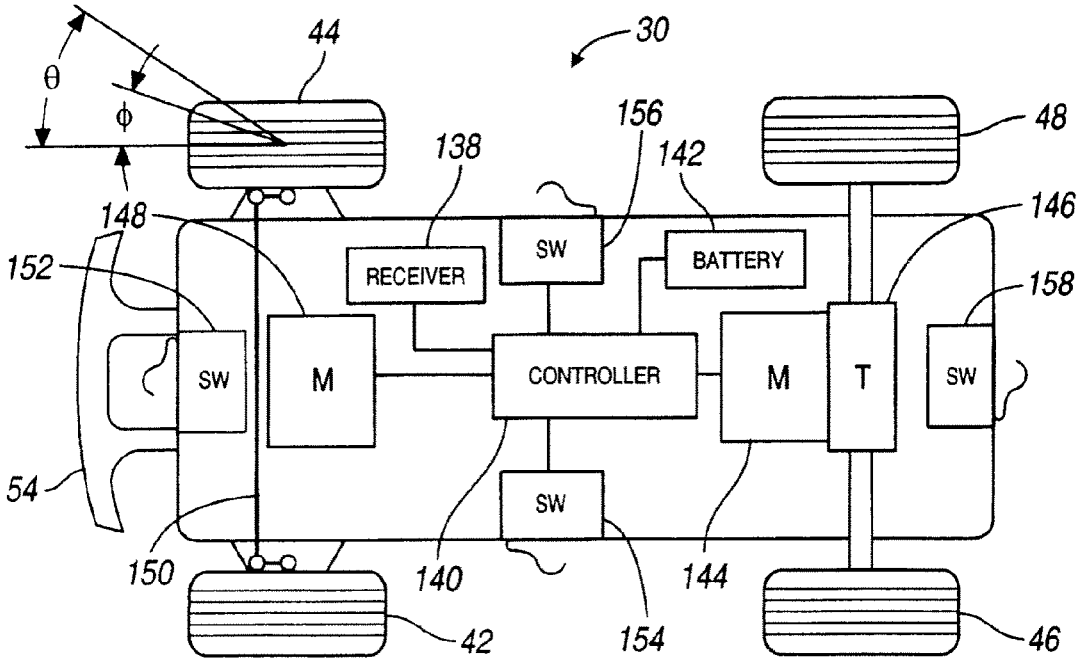
FIG. 11 is a schematic view of a remotely controlled vehicle in accordance with the present invention.

Referring now to FIG. 11, the remotely controlled vehicle 30 is depicted schematically for illustrating controls of the vehicle 30. The vehicle 30 includes a receiver 138 for receiving signals transmitted from the remote control 32. The remote control may transmit a signal over a radio frequency with various pulse patterns for indicating various signals such as forward, reverse, left, right, or a combination thereof. These signals may be transmitted from the antenna 34 of the remote control 32 and correspondingly received by the antenna 36 of the vehicle 30 and conveyed to the receiver 138.

The receiver 138 is in communication with a controller 140 of the vehicle 30. The controller 140 may be an integrated circuit, which may be provided on a printed circuit board. The receiver 138 may also be incorporated into the integrated circuit or printed circuit board of the controller 140. Manually input signals to the remote control 32 are conveyed to the receiver 138 of the remotely controlled vehicle 30. The signals that are received from the receiver 138 are conveyed to the controller 140 for controlling operations of the vehicle. The controller 140 is in communication with a power source such as a battery 142 for powering the operation of the vehicle 30. The controller is in communication with a drive motor 144 which drives a transmission 146 for driving the rear wheels 46, 48. The controller 140 is also in communication with a steering motor 148 that drives the steering linkage 150 for steering the vehicle.

Figure 12:
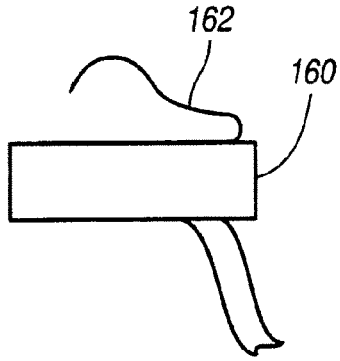
FIG. 12 is a switch for utilization with the remotely controlled vehicle of FIG. 10.

The vehicle 30 further includes a series of impact sensors for detecting an impact to the vehicle 30. Although various impact sensors may be utilized such as inertia switches and the like, a series of limit switches 152, 154, 156, 158 may be provided on the chassis 40 for detecting an impact to the front bumper fascia 74, side panels 58, 60 or the rear panel 62. Each of the limit switches 152, 154, 156, 158 may be a conventional limit switch as illustrated in FIG. 12 with switch body 160 with a contact arm 162. The contact arm 162 may be displaced from the chassis 40 for contacting a corresponding translatable body component such as the front bumper fascia 74, side body panels 58, 60 or the rear panel 62 so that upon impact the contact arm 162 is translated to engagement with the switch body 160 for sending a signal to the controller 140 indicating an impact at that location. The invention contemplates that limit switches 152, 154, 156, 158 may be disposed at various locations along the vehicle body, and four locations are illustrated by way of example. The invention also contemplates that impact sensors may be utilized with various vehicle bodies, for example vehicle body 108 of FIG. 7 and vehicle body 132 of FIG. 10 may be utilized with switches wherein the contact arm 162 of the switch is actuated by the striker 118 of the vehicle body.

The signals from the impact switches 152, 154, 156, 158 may be utilized by the controller 140 for altering the controls of the vehicle 30 for simulating damage to the vehicle 30. For example, indication of a front end or rear end impact from switches 152 or 158 may each be utilized for reducing a speed of the vehicle 30 incrementally by, for example, five percent. Alternatively, the impact signals may be utilized by the controller 140 for delaying controls of the drive motor 144 for simulating a faulty drivetrain. Impacts to the lateral sides of the vehicle 30, which are indicated by switches 154, 156 may be utilized for simulating damage to steering of the vehicle 30 by altering controls to the steering motor 148. For example, steering in a particular direction may be delayed or may be utilized for altering a range of steering. In FIG. 11, wheel 44 is indicated with a steering range in a right hand turn direction indicated by the angle $\theta$. Upon receipt of an impact signal at switch 156 to the controller, the steering range in the right hand direction may be reduced to an angle $\phi$ so that wider turning radiuses are required by the vehicle 30. Likewise, upon impact to the switch 154, a steering range in the left hand direction may be reduced from $\theta$ to $\phi$ as well. Alternatively, the impact signals from switches 154, 156 may be utilized for delaying controls to the steering motor 148 to simulate damage to steering or loss of power steering or the like.

The utilization of impact switches to alter or simulate degradation of the operation of the vehicle 30 may be utilized in combination with the translatable body component so that the vehicle 30 simulates the appearance of a damaged vehicle and the operation of a damaged vehicle. Alternatively, impact sensors may be utilized alone so that merely the operation of the vehicle 30 is altered without altering the appearance of the vehicle 30. Alternatively, impacts to the vehicle and simulated damaged panels may be unrelated.

The impact conditions of the operation of the vehicle 30 may be reset manually. For example, the user may merely reassemble ejected body panels 56, 58, 60, 62, or in the employment of non-deployable panels, the user may actuate the associated latch mechanism 124 for releasing the indented body panel 110, 112, 114, 116. Such manual resetting of the impact conditions can be done after a competition between users or during competition, to simulate a pit stop as is known in professional racing.

Figure 13:
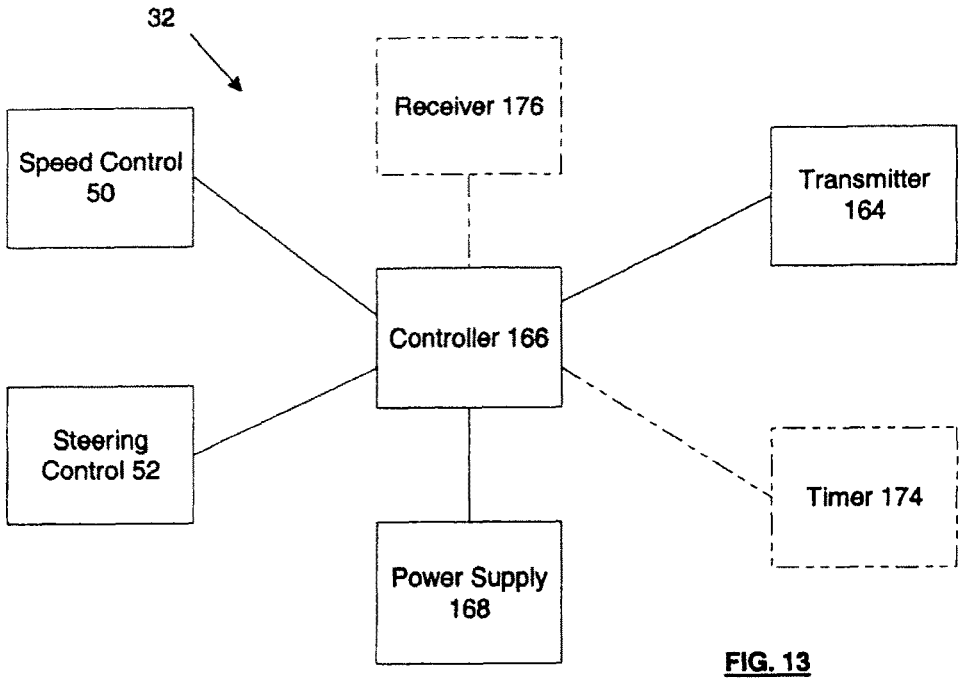
FIG. 13 is a schematic diagram of a remote control in accordance with the present invention.
Figure 14:
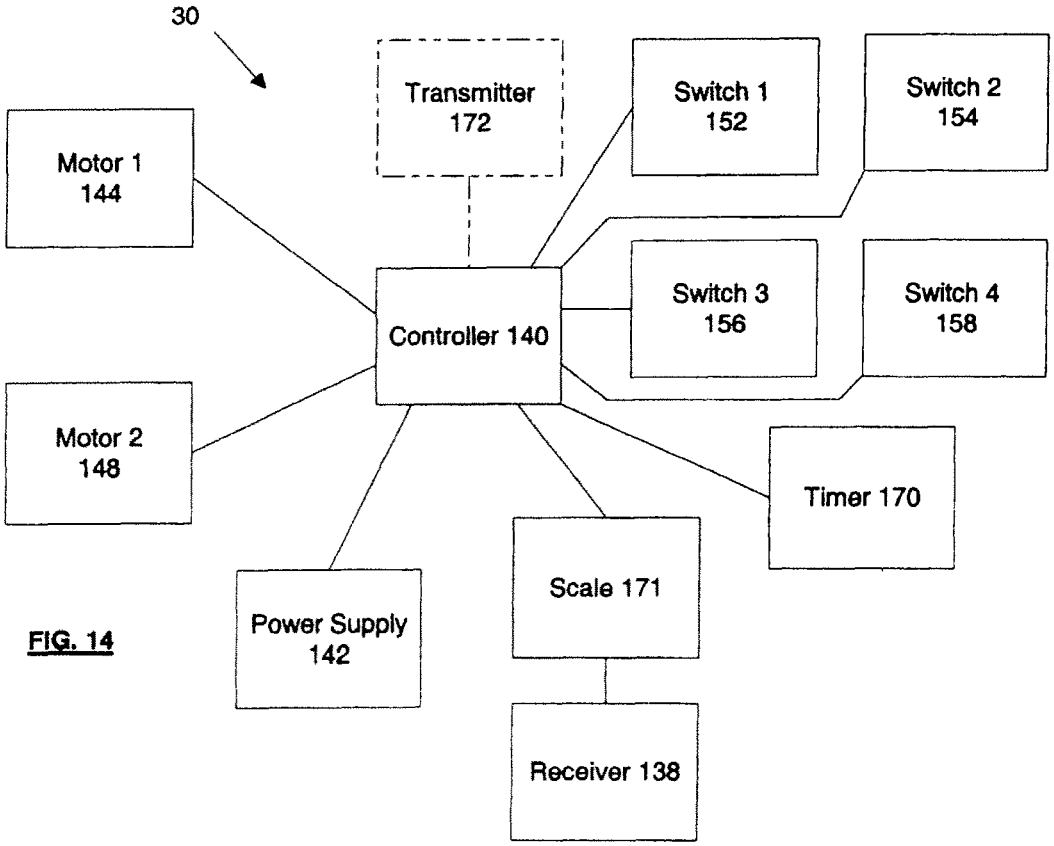
FIG. 14 is a schematic view of a remotely controlled vehicle in accordance with the present invention.

Referring now to FIGS. 13 and 14, the remote control 32 is illustrated schematically in FIG. 13 and the remotely controlled vehicle 30 is illustrated schematically in FIG. 14. The remote control 32 includes a speed control 50 and a steering control 52, which are manually actuated for conveying signals through a transmitter 164, which is in communication with the antenna 34. The remote control 32 may also include a controller 166 for communicating between the manual controls 50, 52 and the transmitter 164. The controller 166 may be an integrated circuit which converts the signals from the manual controls 50, 52 to modulated pulses that are transmitted through a radio frequency from the transmitter 164. The remote control 32 also includes a power supply 168 such as a battery pack for powering the remote control 32.

With reference now to FIG. 14, the remotely controlled vehicle 30 includes the receiver 138, which receives signals transmitted from the transmitter 164 at the remote control 32. The receiver 138 is in communication with the controller 140 for controlling the drive motor 144 and the steering motor 148 for controlling operations of the vehicle 30. A power supply 142 is provided for powering the operations of the vehicle 30. Various impact sensor such as switches 152, 154, 156, 158 are provided in communication with the controller 140 (or alternatively in communication with controller 166) for indicating impact conditions to the controller 140.

The automotive vehicle 30 may be provided with further degradation characteristics. For example, a timer 170 may be provided in the vehicle 30 for timing a period of operation of the vehicle 30. The timer 170 may be utilized to simulate use of fuel by the vehicle 30, which is a common concern in professional racing. Thus, the timer 170 may be set for a predetermined amount of time requiring the user to stop the vehicle 30 in a simulated pit stop in order to refuel or reset the timer 170. The timer 170 may be provided by a separate chip or circuit within the vehicle 30 or may be formed integrally with an integrated circuit or printed board of the controller 140.

Various degradation operations may be utilized in cooperation with the timer 170. For example, upon reaching a predetermined time set in the timer 170, the controller 140 may discontinue operation of the motors 144, 148. Alternatively, the maximum speed of the drive motor 144 may be reduced within a certain time range to simulate a vehicle that is running low on fuel.

The timer 170 may include a reset switch which may be actuated manually to simulate a pit stop. Alternatively, the vehicle 30 may include a scale 171 in communication with the controller 140 and the receiver 138 for measuring an amplitude of the signal transmitted by the transmitter 164. Upon the signal from the transmitter 164 reaching a predefined amplitude, corresponding to the vehicle 30 being adjacent to the remote control 32, the scale 171 may reset the timer 170, or time may be added to the timer 170 gradually at a rate greater than the rate at which time is reduced on the timer 170. In order to simulate a refueling operation, the user may control the vehicle 30 to return to the user to simulate a pit stop. Upon the scale 171 measuring an amplitude of the transmitter 164 associated with a vehicle 30 being within a certain range of the user, the timer 170 is reset or gradually increased to simulate a refueling of the vehicle. Thus, the user may have to budget his time or simulated fuel, which is a common concern associated with professional racing.

Instead of simulated fuel conditions being measured as a function of time, the simulated fuel conditions could be measured as a function of distance. The scale 171 may include an odometer for measuring a distance traveled by the vehicle 30. Even further, the scale 171 may be a speedometer and the scale 171 and timer 170 may simulate fuel loss as a function of vehicle velocity and time.

Alternatively, a designated pit stop may be provided in communication with the timer 170 for resetting the timer. The pit stop may include a proximity sensor for indicating a presence of the vehicle 30 during a simulated refueling operation.

In order for the user to monitor the time limit of the timer 170, a transmitter 172 may be provided on the vehicle 30 in communication with the controller 140. The transmitter 172 may be a light source mounted on the vehicle body 38 for indicating a low range of the timer 170, such as a low fuel light which may be viewed by the user 32 at a distance from the vehicle 30.

Alternatively, a timer 174 may be provided in the remote control 32 in communication with controller 166, which may be reset manually by the user for monitoring the time on the timer 170 of the vehicle 30. A gas gauge may be provided on the remote control 32 for illustrating the time as a simulated fluid volume. Alternatively, the transmitter 172 of the vehicle 30 may transmit a signal upon a radio frequency that is received within a receiver 176 of the remote control 32. The receiver 176 may be in communication with the controller 166 for indicating to the user that the vehicle 30 is reaching a low fuel condition. For example, a low fuel light may be provided on the remote control 32. Alternatively, a timer 174 may be provided on the remote control 32 that is synchronized with the timer 170 via signals transmitted from transmitter 172 of the vehicle 30 and received by the receiver 176 of the remote control 32 so that the user has a real-time indication of the simulated fuel level of the vehicle 30.

The low fuel simulation may be utilized alone or in combination with the simulated damage controls of the vehicle 30 by utilization of impact sensors. The simulated low fuel condition of the vehicle 30 may also be utilized alone or in combination with the simulated aesthetic damage as discussed above with the various translatable body components.

The invention also contemplates providing adaptive feedback to the user at the remote control 32. For example, the vehicle transmitter 172 may transmit signals indicative of conditions perceived by the vehicle 30. These signals may be received by the receiver 176 of the remote control 32. The controller 166 of the remote control 32 may process these signals for providing feedback to the user through a display screen or through physical manipulations imparted to the user. For example, vibrations may be imparted to the remote control 32 in response to an impact measured by the switches 152, 154, 156, 158 in the vehicle 30 so that the user experiences a corresponding motion or vibration.

Additionally, the speed control 50 and the steering control 52 of the remote control 32 may include brakes, which are applied in correspondence with degradation features to the vehicle 30. For example, a brake may be applied to the steering control 52 when the vehicle 30 is traveling at a high velocity or to apply a restraint in response to impacts to the vehicle 30. For example, if the steering of the vehicle 30 is limited in response to an impact, the steering control 52 may become difficult to simulate a situation corresponding to when power steering fails in a vehicle and the user is required to overcome the steering linkage without a power assist. Of course, other adaptive feedback features may be provided to the remote control 32 within the spirit and scope of the present invention.

Figure 15:
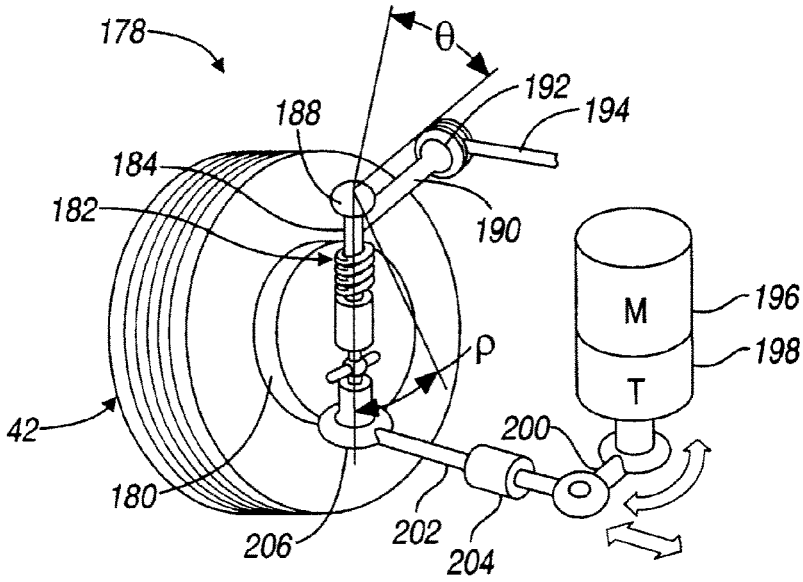
FIG. 15 is a perspective view of a portion of a suspension assembly for a remotely controlled vehicle in accordance with the present invention.

With reference now to FIG. 15, a suspension assembly 178 is illustrated in accordance with the present invention. The suspension assembly 178 may be utilized on a wheel such as the front left wheel 42 of the vehicle 30. The wheel 42 is mounted to a hub 180, which is connected to the chassis 40 through the suspension assembly 178 for suspending the chassis 40 relative to a medium of travel, such as an underlying support surface upon which the vehicle 30 travels. The suspension assembly 178 includes a strut 182, which includes a vertical link 184 coupled for linear translation in a vertical direction to the hub 180. The coupling of the vertical link 184 and the hub 180 may include a damper for damping vibrations from the wheel 42 to the chassis 40. Additionally, a coil compression spring 186 may be provided for absorbing forces imparted to the suspension assembly 178 such as jounces as the vehicle travels.

A top portion of the strut 182 includes an upper control arm defined by a first ball joint 188, which is coupled to the chassis 40 of the vehicle 30. The ball joint 188 is provided at the upper control arm for a spherical connection with the vehicle 30 thereby permitting both steering within a steering range, such as steering range $\theta$, and angular adjustment offset from vertical, which is often referred to as camber and is indicated in FIG. 15 by $\rho$. The upper control arm includes a rocker link 190 affixed to the vertical link 184 for pivoting the vertical link 184 and the hub 180 relative to the vehicle 30 about the ball joint 188. The rocker link 190 includes a ball joint 192 pivotally connected to a steering linkage 194. The steering linkage 194 is driven by the steering motor 148 which pivots the wheel 42 relative to the vehicle 30.

In response to an impact condition of the vehicle, the controller such as controller 140 of the vehicle 30, may adjust the camber angle of one of the wheels such as wheel 42 of the vehicle 30. Accordingly, the controller may be in communication with a camber control motor 196 mounted in the chassis 40. The motor 196 drives a transmission such as a gearbox 198 for imparting a reduced rotation to a driven link 200, which is pivotally mounted in the vehicle. The driven link 200 is also pivotally connected to a lower control arm link 202. The lower control arm link 202 is translatably connected to the chassis 40 by a linear bearing 204. The lower control arm link 202 is also pivotally connected to a lower end of the vertical link 184 by another ball joint 206. Accordingly, in response to an impact signal, the controller may drive the motor 196 such that the camber angle $\rho$ of the wheel 42 is offset continuously for a continuous disruption of the suspension of the vehicle 30 that causes the wheel 42 to wobble relative to the chassis 40.

Alternatively, the motor 196 may drive the driven link 200 for oscillation about its pivotal connection such as the arcuate arrow in FIG. 15 for driving the lower control arm link 202 for reciprocation as illustrated by the linear arrow in FIG. 15. The back and forth may adjust the camber angle $\rho$ offset from vertical in one direction, offset from vertical in both directions and incrementally for various suspension modifications for simulating a vehicle with a damaged or partially damaged suspension assembly.

Figure 16:
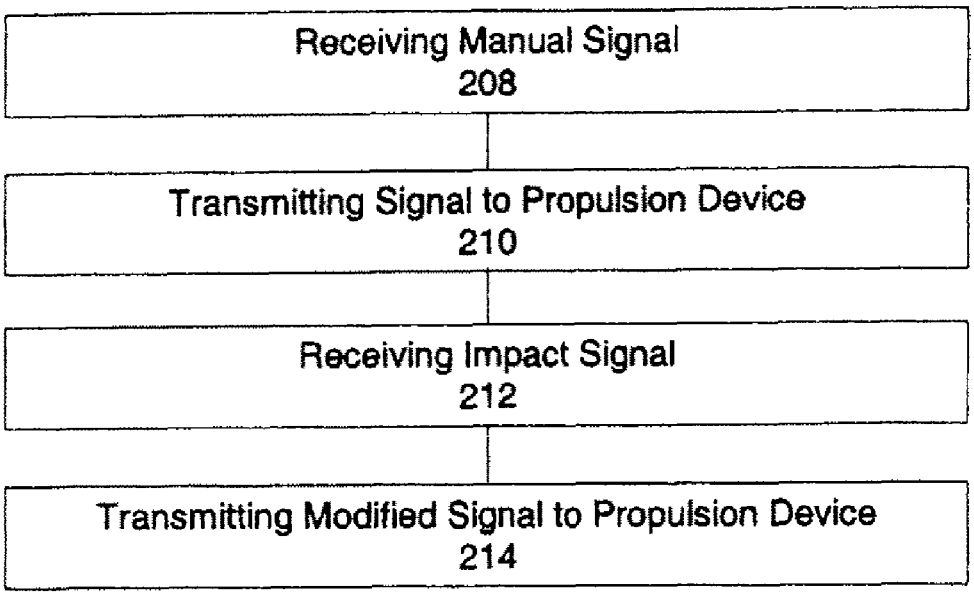
FIG. 16 is a flowchart for computer-executable instructions for a computer-readable medium in accordance with the present invention.

Referring now to FIG. 16, one of the various methods of the present invention is illustrated by way of a flowchart. The flowchart at FIG. 16 illustrates steps performed by computer-executable instructions of a computer-readable medium such as instructions within the vehicle controller 140. At block 208, a manual signal is received, which is input to the remote control 32 and transmitted to the vehicle 30. At block 210 the signal is transmitted to the propulsion device for translation of the vehicle. At block 212 an impact signal is received from an impact sensor indicative of an impact of the vehicle 30. At block 214 a modified signal is transmitted to the propulsion device associated with the manual input controls to simulate operation of a damaged vehicle in response to receipt of the impact signal.

The flowchart of FIG. 16 is illustrated by way of example and is not limiting of the computer-readable medium of the present invention, which may be provided within the vehicle controller 140. For example, a signal may be received associated with another impact of the vehicle. A further modified signal may be transmitted to the propulsion device to simulate a further damaged vehicle. Additionally, a signal may be received associated with resetting of an impact condition of a vehicle. An unmodified signal may be transmitted to the propulsion device associated with the manual input controls.

Figure 17:
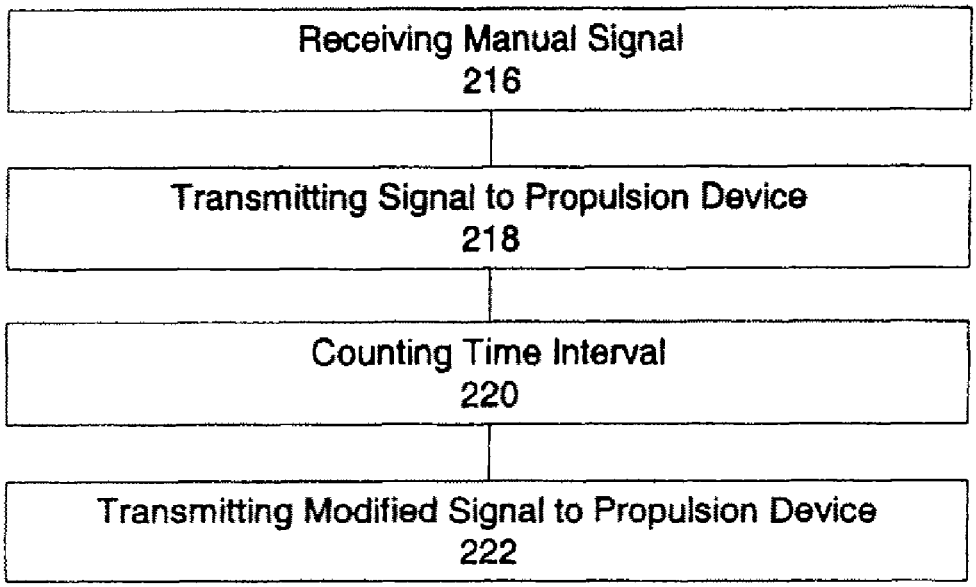
FIG. 17 is another flowchart for computer-executable instructions for a computer-readable medium in accordance with the present invention.

Referring now to FIG. 17 another flowchart is illustrated in accordance with the present invention. The flowchart of FIG. 17 illustrates a computer-readable medium having computer-executable instructions for forming a method with steps that flow from the flowchart. At block 216, a signal is received associated with manually input controls for driving the remotely controlled vehicle. At block 218, a signal is transmitted to the propulsion device of the vehicle corresponding to the manually input controls. At block 220 a time interval is counted; and at block 222 a modified signal is transmitted to the propulsion device of the vehicle for simulating a low fuel condition.

Of course further steps may be contemplated within the scope of the present invention. As discussed above with reference to the controls of the vehicle 30, an amplitude of the signal associated with the manually input controls may be measured. Accordingly, an unmodified signal may be transmitted to the propulsion device, associated with the manually input controls, upon the signal associated with the manually input controls reaching a predetermined level.

In view of the above disclosed features, various games may be derived from the remotely controlled vehicle 30. For example, various competitions may be developed, such as races, demolition derbies, obstacle challenges or the like, which utilize some or all of the degradation features. Additionally, other products such as scaled demolition derby arenas or race tracks may also be employed. Pit stops may be provided alone or incorporated into arenas or tracks.

Figure 18:
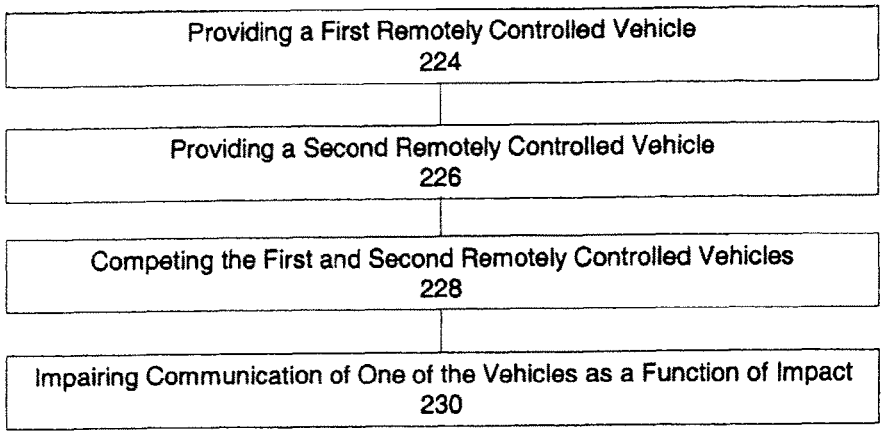
FIG. 18 is a flowchart for a method for playing a game in accordance with the present invention.

Referring now to FIG. 18, a flowchart is illustrated for a method for playing a game in accordance with the present invention. At block 224, a first remotely controlled vehicle is provided. A second remotely controlled vehicle is provided at block 226. The remotely controlled vehicles compete at block 228. At block 230, communication with one of the vehicles is impaired as a function of impact. Of course, communication of all vehicles may be impaired as a function of impact to the associated vehicle.

Figure 19:
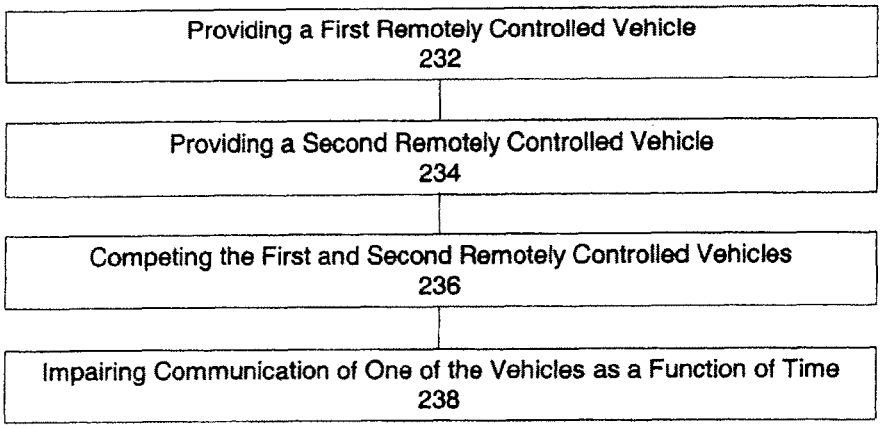
FIG. 19 is another flowchart for another method for playing a game in accordance with the present invention.

With reference to FIG. 19, another flowchart is provided for depicting a method for playing a game in accordance with the present invention. A first remotely controlled vehicle is provided at block 232 and a second remotely controlled vehicle is provided at block 234. The first and second remotely controlled vehicles compete at block 236. Communication of one of the vehicles is impaired as a function of time at block 238, thus simulating a low fuel condition or any other condition of a vehicle that simulates a requirement of maintenance.

Figure 20:
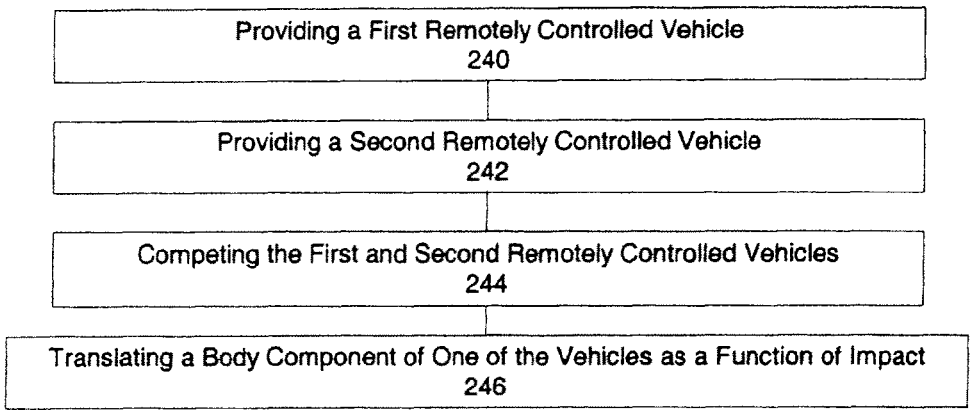
FIG. 20 is yet another flowchart for another method for playing a game in accordance with the present invention.

At FIG. 20, another embodiment for playing a game is summarized by way of a flowchart. A first remotely controlled vehicle is provided at block 240 and a second remotely controlled vehicle is provided at block 242. The first and second remotely controlled vehicles compete at block 244. A body component of one of the vehicles is translated at block 246 as a function of impact to aesthetically simulate damage to a vehicle.

Figure 21:
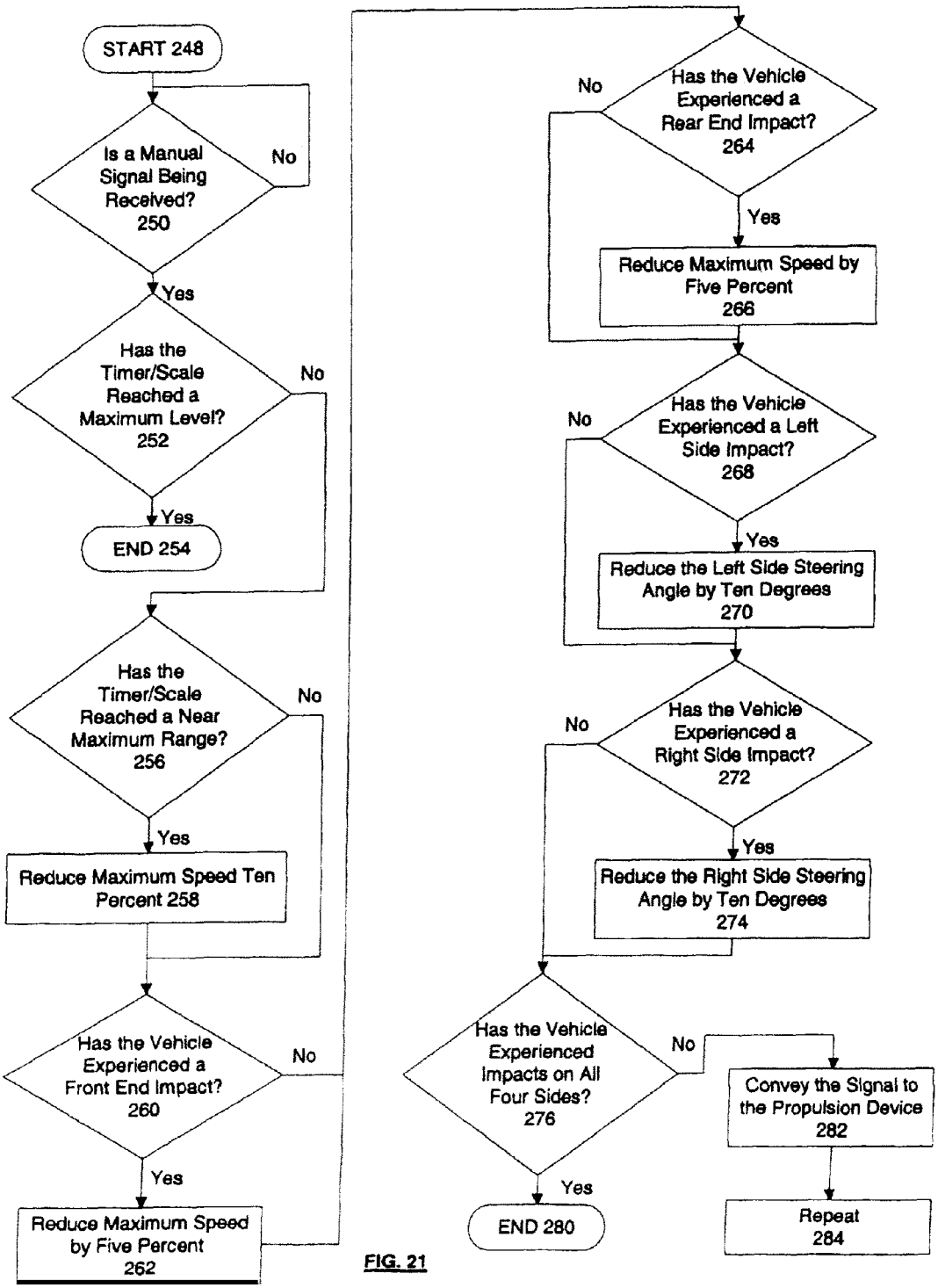
FIG. 21 is yet another flowchart for computer-executable instructions for a computer-readable medium in accordance with the present invention.

With reference now to FIG. 21, another method is illustrated, which is performed by computer-executable instructions in a computer-readable medium such as within the controller 140 of the vehicle 30 or the controller 166 of the remote control 32. Although various methods are contemplated by the present invention, the method of FIG. 21 illustrates one method for a vehicle that has a timer or a scale for simulating a low fuel level and has impact sensors at a front end, a rear end and both lateral sides of the vehicle. Of course, the invention contemplates any number or combination of degradation features such as simulated low fuel and damage as a result of impacts to the vehicle.

The method may begin at start block 248. At decision block 250, the controller determines whether a manual signal is being received. If a manual signal has not been received, then decision block 250 is repeated. If a manual signal has been received, at decision block 252 the controller determines whether a timer or scale has reached a maximum level corresponding with the simulated fuel empty condition of the vehicle. If the timer or scale have reached the maximum level, the method ends at end block 254. If not, the method continues to decision block 256.

At decision block 256, it is determined whether the timer or scale has reached a near maximum range associated with the low fuel condition. If so, a maximum speed is reduced by ten percent at block 258. If not, the method continues to decision block 260. At decision block 260, the controller determines whether the vehicle has experienced a front end impact. If so, a degradation simulation may be performed such as a reduction of a maximum speed of the vehicle by, for example, five percent at block 262. Then the method continues on to block 264. If there has not been a front end impact, the method continues to the decision block 264.

At decision block 264, it is determined whether the vehicle has experienced a rear end impact. If so, a maximum speed in reduced by five percent at block 266 and then a decision at block 268 is determined. If not, decision block 264 continues on to decision block 268.

At decision block 268, the controller determines whether the vehicle has experienced a left side impact. If the vehicle has experienced a left side impact, the left side steering angle is reduced by ten degrees at block 270. If not, block 270 is avoided and the method continues to decision block 272.

At decision block 272, the controller determines whether the vehicle 30 has experienced a right side impact. If so, the right side steering angle is reduced by ten degrees at block 274. If not, block 274 is avoided.

At decision block 276, the controller determines whether the vehicle has experienced impacts on all four sides. If so, the method ends at end block 280. If not, a signal is conveyed to the propulsion device at 282 communicating the manual signal received from the remote control 32. The signal may be modified depending whether the method performed the steps at blocks 258, 262, 266, 270 or 274. After the signal is conveyed to the propulsion device at block 282, the method is repeated at block 284.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A remotely controlled vehicle comprising:

a housing;

a propulsion device provided on the housing for translating the vehicle;

a receiver provided on the housing for receiving signals from a remote control and conveying the signals to the propulsion device;

a controller in communication with one of the receiver and the remote control for controlling the propulsion of the vehicle, and for altering the signals to the propulsion device to simulate operation of a vehicle requiring maintenance; and an impact sensor provided on the housing in communication with the controller for sending a signal to the controller associated with an impact of the vehicle wherein the controller alters control of the propulsion device after receipt of the impact signal;

wherein the propulsion device further comprises steering of the vehicle, and control of the steering is altered by the controller after receipt of the impact signal.

2. The remotely controlled vehicle of claim 1 wherein a steering angle range is lessened after receipt of the impact signal.

3. The remotely controlled vehicle of claim 1 wherein signals for controlling the steering are delayed after receipt of the impact signal.

4. The remotely controlled vehicle of claim 1 further comprising at least one translatable body component in cooperation with the impact sensor, the at least one translatable body component being adapted for translation from a first position to a second position upon impact of the vehicle for simulating an appearance of a damaged vehicle that may require maintenance or for actuation of the impact sensor.

5. The remotely controlled vehicle of claim 1 further comprising a timer for altering the control of the propulsion device after a predefined period of time.

6. The remotely controlled vehicle of claim 1 wherein the controller alters the signals in response to conditions that occur during the operation of the remotely controlled vehicle.

7. The remotely controlled vehicle of claim 1 further comprising a suspension system for suspending the housing relative to a medium upon which the housing travels, wherein the suspension system is in communication with the controller and the suspension system is altered after receipt of the impact signal.

8. The remotely controlled vehicle of claim 1 wherein the impact sensor further comprises a limit switch.

9. The remotely controlled vehicle of claim 1 wherein the controller is provided in the housing in communication with the propulsion device and the receiver.

10. The remotely controlled vehicle of claim 1 wherein the propulsion device further comprises a motor for driving the vehicle, and control of the motor is altered by the controller after receipt of the impact signal.

11. The remotely controlled vehicle of claim 10 wherein a maximum velocity of the vehicle is lessened by the controller after receipt of the impact signal.

12. The remotely controlled vehicle of claim 10 wherein control signals to the motor are delayed after receipt of the impact signal.

13. A remotely controlled vehicle comprising:

a housing;

a propulsion device provided on the housing for translating the vehicle;

a receiver provided on the housing for receiving signals from a remote control and conveying the signals to the propulsion device;

a controller in communication with one of the receiver and the remote control for controlling the propulsion of the vehicle;

an impact sensor provided on the housing in communication with the controller for sending a signal to the controller associated with an impact of the vehicle; and a suspension system for suspending the housing relative to a medium upon which the housing travels, wherein the suspension system is in communication with the controller and the suspension system is altered after receipt of the impact signal.

14. The remotely controlled vehicle of claim 13 wherein the propulsion device further comprises steering of the vehicle, and control of the steering is altered by the controller after receipt of the impact signal.

15. The remotely controlled vehicle of claim 13 further comprising a timer for altering the control of the propulsion device after a predefined period of time.

16. The remotely controlled vehicle of claim 13 further comprising at least one translatable body component in cooperation with the impact sensor, the at least one translatable body component being adapted for translation from a first position to a second position upon impact of the vehicle for simulating an appearance of a damaged vehicle that may require maintenance or for actuation of the impact sensor.

17. The remotely controlled vehicle of claim 13 wherein the propulsion device further comprises a motor for driving the vehicle, and control of the motor is altered by the controller after receipt of the impact signal.

18. The remotely controlled vehicle of claim 17 wherein a maximum velocity of the vehicle is lessened by the controller after receipt of the impact signal.

19. The remotely controlled vehicle of claim 17 wherein control signals to the motor are delayed after receipt of the impact signal.

20. A remotely controlled vehicle comprising:

a housing;

a propulsion device provided on the housing for translating the vehicle;

a receiver provided on the housing for receiving signals from a remote control and conveying the signals to the propulsion device;

a controller in communication with one of the receiver and the remote control for controlling the propulsion of the vehicle, and for altering the signals to the propulsion device to simulate operation of a vehicle requiring maintenance; and a timer for altering the control of the propulsion device after a predefined period of time.

* * * * *